US005395156A

United States Patent [19]

Friedman

[11] Patent Number: 5,395,156

[45] Date of Patent: Mar. 7, 1995

[54] ADJUSTABLE STORAGE TABLE

[76] Inventor: Alan H. Friedman, 15 Tioga Pass, Short Hills, N.J. 07078

[21] Appl. No.: 7,759

[22] Filed: Jan. 22, 1993

[51] Int. Cl.[6] ..... A47C 15/00

[52] U.S. Cl. ..... 297/232; 248/167; 312/316; D6/336; 108/69

[58] Field of Search ..... 297/232; 108/69, 65; 312/235.6, 313, 315, 316; 248/167; D6/335, 336, 429, 440, 441, 489

[56] References Cited

U.S. PATENT DOCUMENTS

| | | | |
|---|---|---|---|
| D. 72,891 | 6/1927 | Crane | D6/489 X |
| D. 297,983 | 10/1988 | Friedman | D6/336 |
| 1,269,084 | 6/1918 | Hussey | 312/313 X |
| 2,520,543 | 8/1950 | Hawkins | 108/25 X |
| 2,771,334 | 11/1956 | Wahlbom | D6/429 X |
| 3,093,410 | 6/1963 | Wilson | 297/232 X |
| 3,318,268 | 5/1967 | Hagwell | 108/25 |
| 3,817,191 | 6/1974 | Hansen et al. | 248/167 X |
| 3,936,110 | 2/1976 | Meggs | 312/316 X |

FOREIGN PATENT DOCUMENTS

| | | | |
|---|---|---|---|
| 717282 | 10/1954 | United Kingdom | 312/316 |

*Primary Examiner*—Kenneth J. Dorner

*Assistant Examiner*—David E. Allred

*Attorney, Agent, or Firm*—Robert A. Elwell; Harold D. Jastram; Jennifer K. Farrar

[57] ABSTRACT

An attractive and versatile storage table which can be interposed between seating units at several angles. It can serve as an arm rest to seating units. The ability to shift between several different angles allows reconfiguration of a seating arrangement to adjust to different room dimensions and focal points. The adjustable storage table includes a generally wedged shaped base and a top surface having a front edge, a back edge, a right edge and a left edge, the right and left edge of which define about a 15 degree angle, a right leaf having a left edge hingedly connected near the right edge of the top surface and having a right leaf edge defining about a 15 degree angle with respect to the left hingedly connected edge is provided on the right side. A right leaf support including a horizontal rail, and a rearwardly mounted leg on the horizontal rail, the rail being hingedly connected to a front vertical support which in turn is hingedly connected to the forward edge of the wedge-shaped base about a first and second pivot access is also provided. A left leaf and leaf support, which are substantially mirror images of the right leaf and its support, are provided.

2 Claims, 7 Drawing Sheets

ADJUSTABLE STORAGE TABLE

BACKGROUND OF THE INVENTION

The present invention relates to a furniture component and in particular relates to a storage table which may be interposed between seating units which are situated at an angle to each other.

Furniture components which provide attractive and comfortable seating are often times separated by tables which are both functional and have a complementary appearance. Typically, such tables would offer either parallel, spaced-apart sides designed to abut the ends of seating units or alternatively, perpendicular sides which could abut the ends of seating units arranged perpendicular to each other with adjoining front corners (i.e. corner table). Such tables tend to limit the alternative arrangements which can be achieved with combinations of seating units and tables and therefore, severely limit versatility in furniture arrangements.

In modern times, motion furniture (i.e. recliners and incliners) have been used extensively in the furniture field. The arrangement of multiple units of motion furniture within a room is additionally limited by the necessity to provide adequate simultaneous deployment space for the ottoman portion of such furniture. Specifically, arrangements of motion furniture on perpendicular sides of an interposed table (i.e. a corner table) typically are considered inappropriate since deployment of one ottoman unit will preclude deployment of the second ottoman unit.

Thus, there is an existing need for a table adapted for interposition between seating units, particularly motion furniture seating units which offers a variety of angles between the motion furniture seating units while additionally providing appropriate spacing to allow simultaneous deployment of ottoman units of motion furniture situated adjacent to each side of the table.

SUMMARY OF THE INVENTION

The present invention provides a table, adapted for interposition between a pair of motion furniture seating units which enables the motion furniture seating units to be placed at a variety of angles with respect to each other and additionally provides appropriate spacing between the angled motion furniture seating units such that the ottomans of both adjacent motion furniture seating units may be fully extended without interference with each other. Additionally, the table of the present invention provides a storage capacity.

The table of this invention also can serve as an arm rest for a seating unit situated adjacent the side of the table. Such a feature is especially significant when considered in regards to motion seating units as it allows for the elimination of arm rests on the motion seating units and therefore saves considerable side-to-side space (or allows additional seating within a given room size.)

The present invention is a modular, sectional storage table, including a wedge-shaped base and a top surface having front edge, back edge and a substantially linear right and a substantially linear left edge, the right and left edges defining a first acute angle, a right leaf having a substantially linear front edge hingedly connected by a left edge to the right edge of the table surface and having a substantially linear right leaf edge and defining a second acute angle between its right and left edges and a right leaf support having a substantially linear front edge and hingedly connected by its right edge to the left edge of the table surface and having a substantially linear leftleaf edge defining a third acute angle with respect to the left hingedly connected edge. The table of the present invention further includes a left leaf support means and a right leaf support means pivotally mounted to the wedge shaped-base of the table. Additionally, the left leaf support means and the right leaf support means include pivotal front directed faces.

DETAILED DESCRIPTION OF THE PREFERRED EMBODIMENTS

Figure 1:
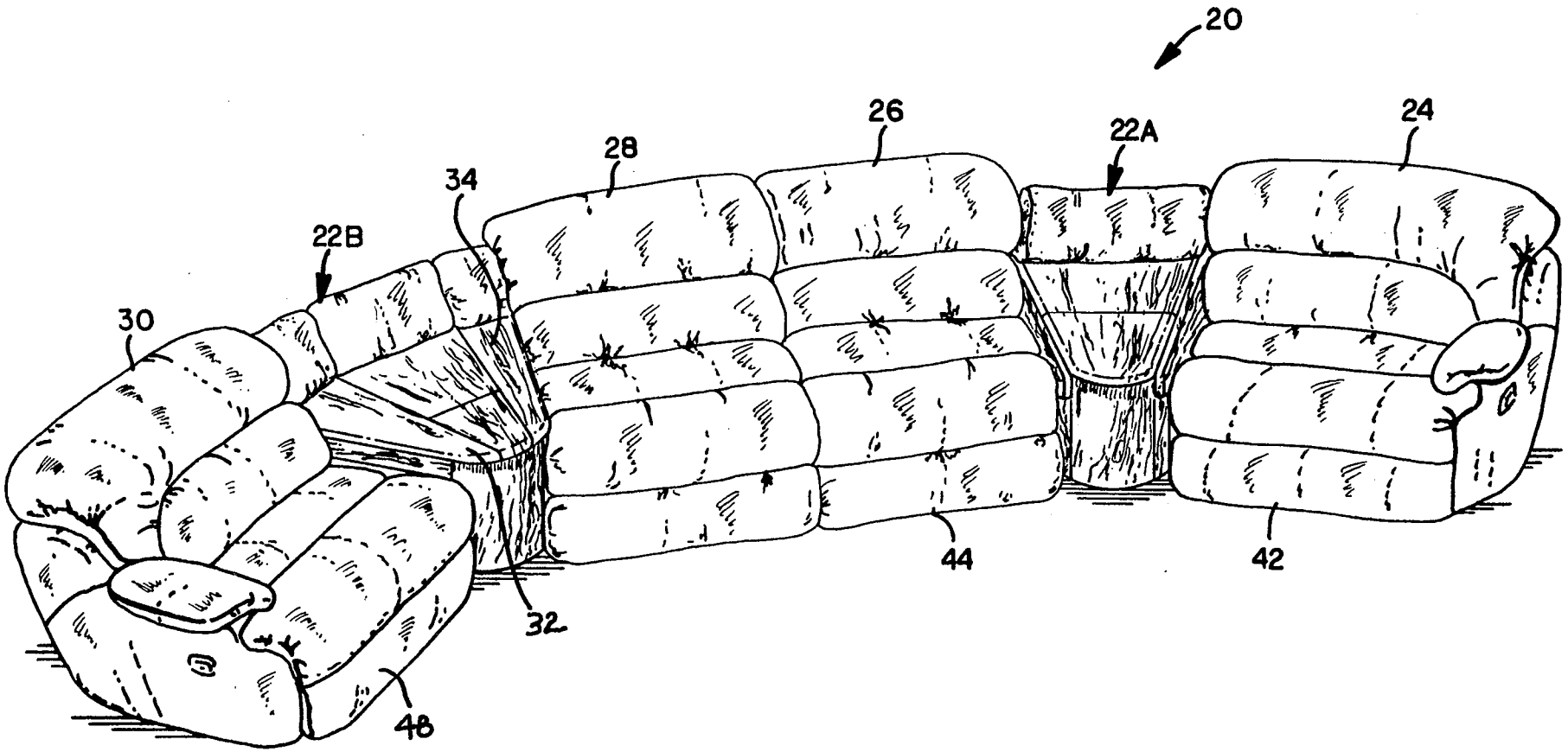
FIG. 1 is a perspective view of two examples of the present invention interposed between motion furniture seating units in an exemplary furniture arrangement thereby depicting the modular seating system of the present invention.

In a preferred embodiment of the present invention, a furniture arrangement 20 includes an adjustable storage table 22A interposed between motion furniture seating units 24 and 26. Another adjustable storage table 22B is also be interposed between motion furniture seating units 28 and 30. Adjustable storage unit 22B is shown with both right leaf 32 and left leaf 34 extended to coordinate with the greater angle between seating units 28 and 30. In contrast, adjustable storage table 22A is shown with leaves 32 and 34 unextended and correspondingly the angle between its adjoining seating units 24 and 26 is reduced. Additionally, adjustable storage table 22A provides spacing between the adjacent seating units 24 and 26 such that ottomans 42 and 44 may be simultaneously extended without interference. Similarly, adjustable storage table 22B spaces motion furniture seating units 28 and 30 such that ottomans 46 and 48 may be simultaneously extended. The spacing required for simultaneous extension of ottomans 48 and 46, which are oriented at a greater angle to each other, is greater than the spacing required for simultaneous extension of ottomans 42 and 44 which are oriented at a lesser angle to each other. The adjustable storage tables 22A and 22B provide such spacing adjustment in the extension of leaves 32 and 34, as will be explained more fully below. As such, a modular seating system is provided. The seating system includes seating units and an adjustable table interposed between the seating unit and wherein the adjustment of the adjustable table alters both the angular relationship between the seating units and the spacing between the seating units.

Figure 2:
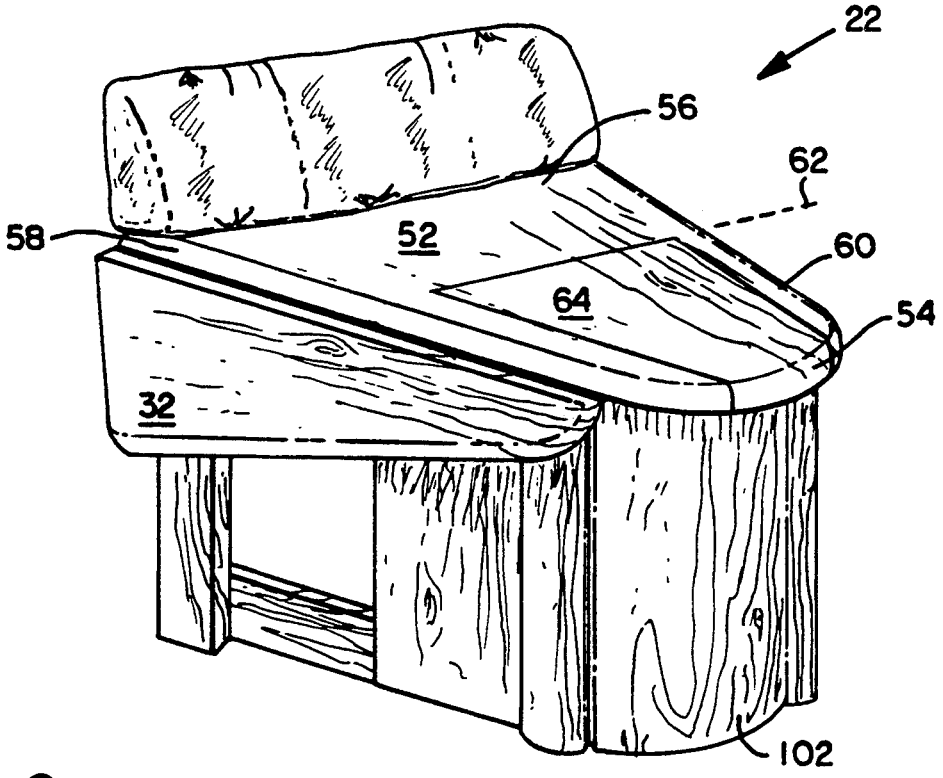
FIG. 2 is a perspective view of the present invention with extension leaves down.
Figure 3:
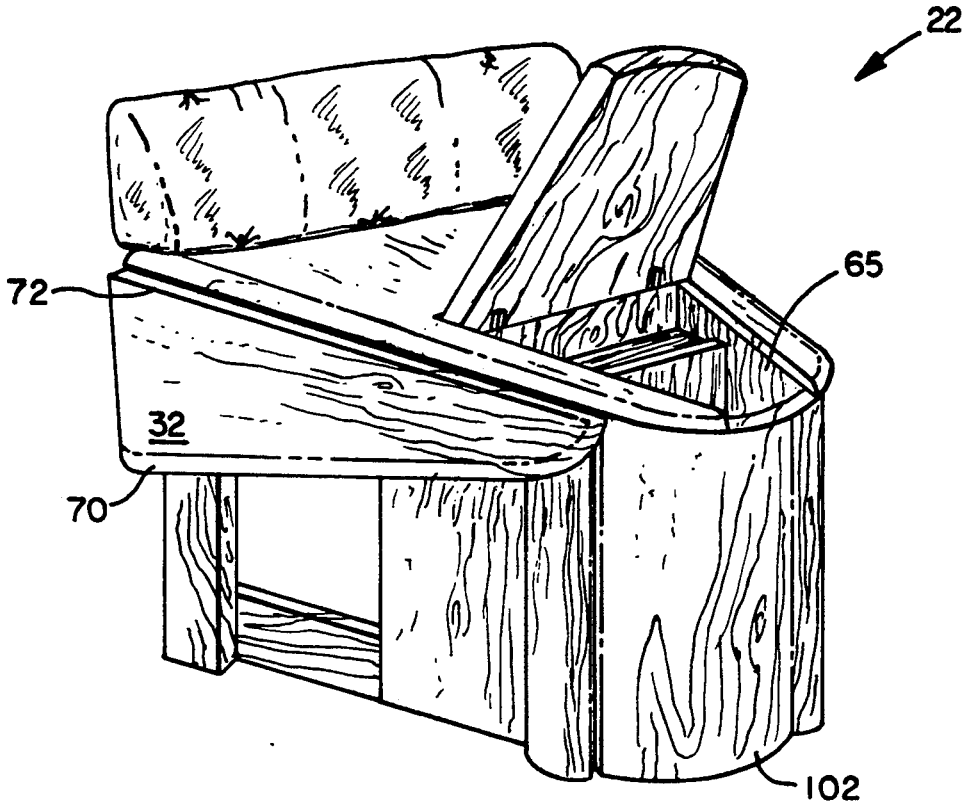
FIG. 3 is a perspective view of the present invention and showing access to the storage compartment.
Figure 4:
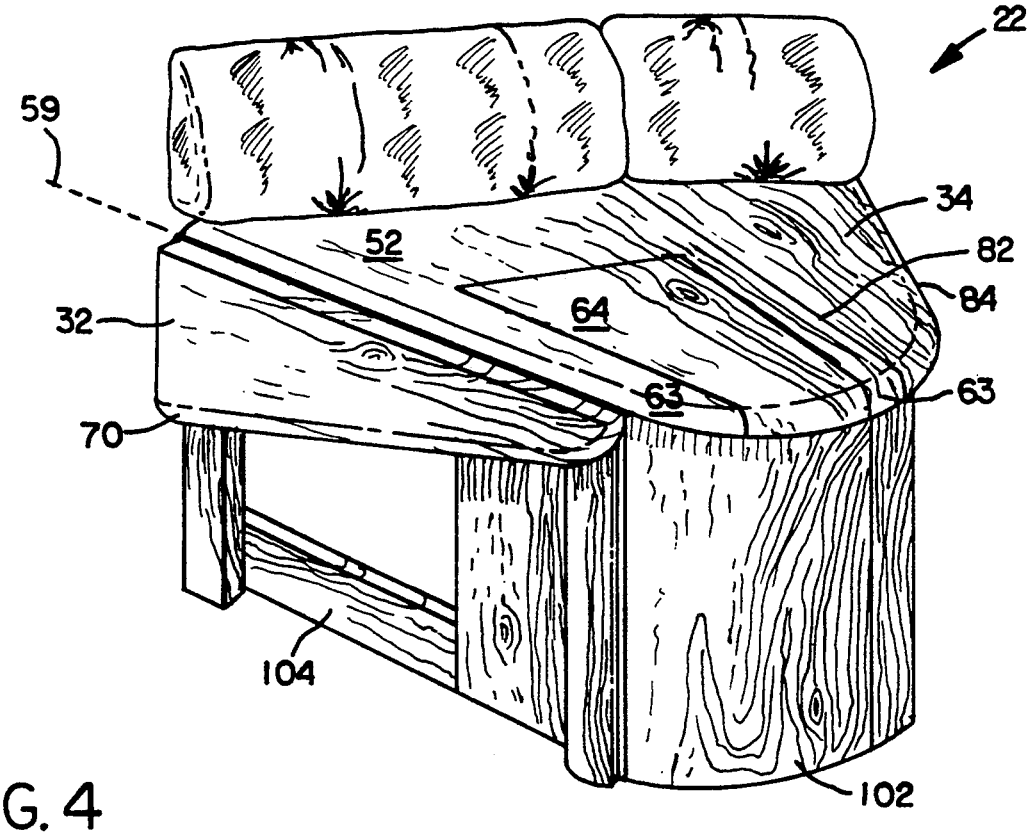
FIG. 4 is another perspective view of the present invention with the left leaf extended and the right leaf down.
Figure 5:
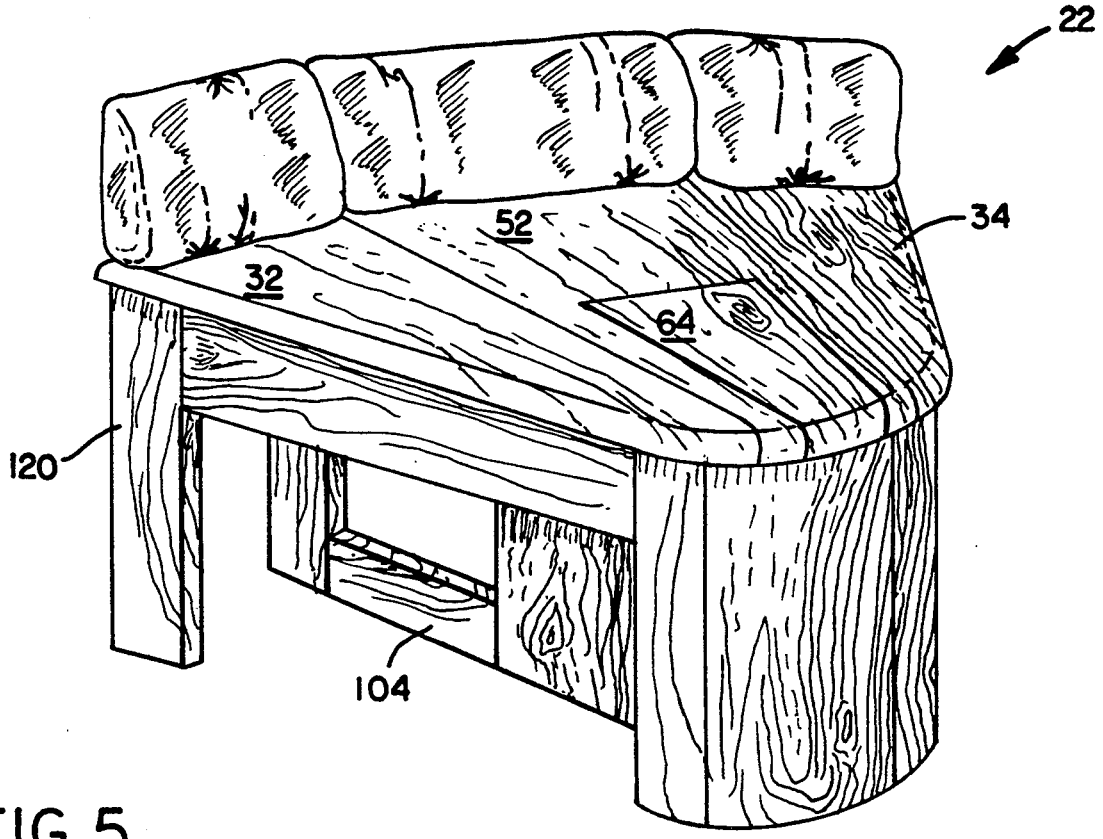
FIG. 5 is a perspective view of the present invention with both leaves extended.
Figure 6:
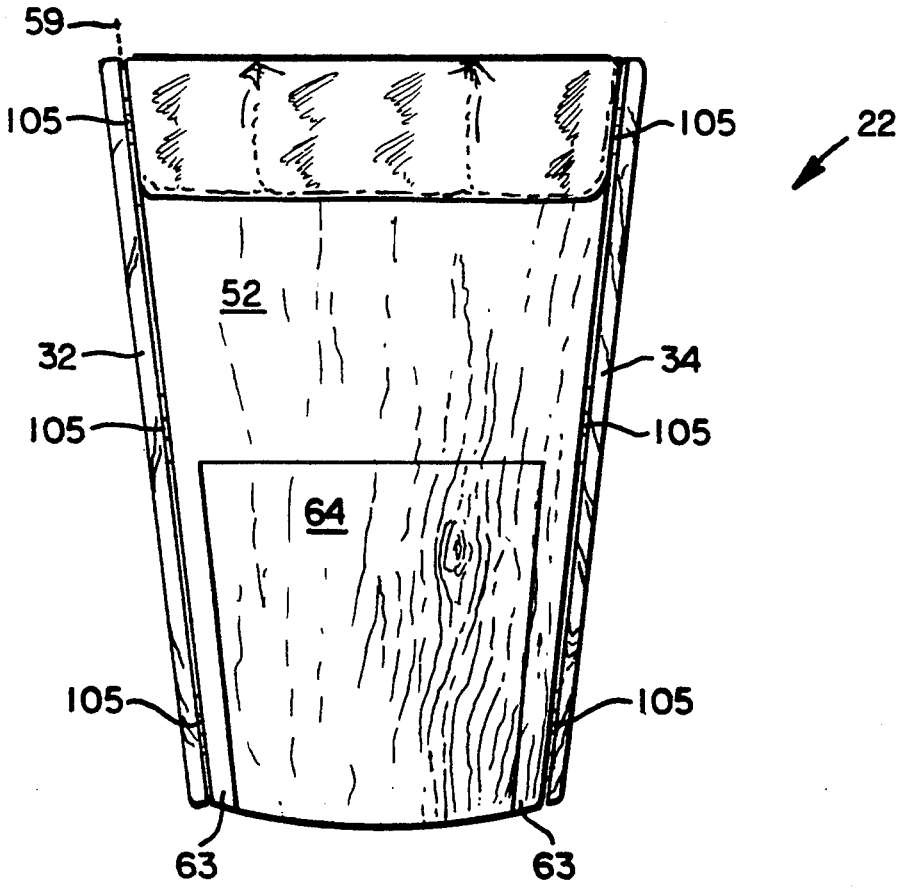
FIG. 6 is a top view of the present invention with both leaves down.
Figure 7:
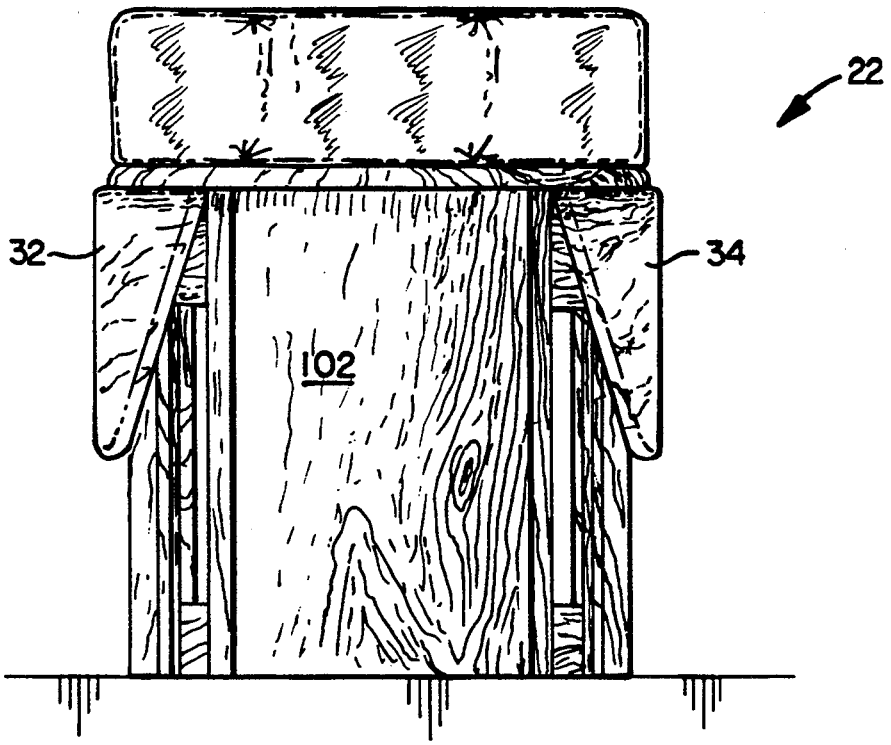
FIG. 7 is a front view of the present invention with both leaves down.
Figure 8:
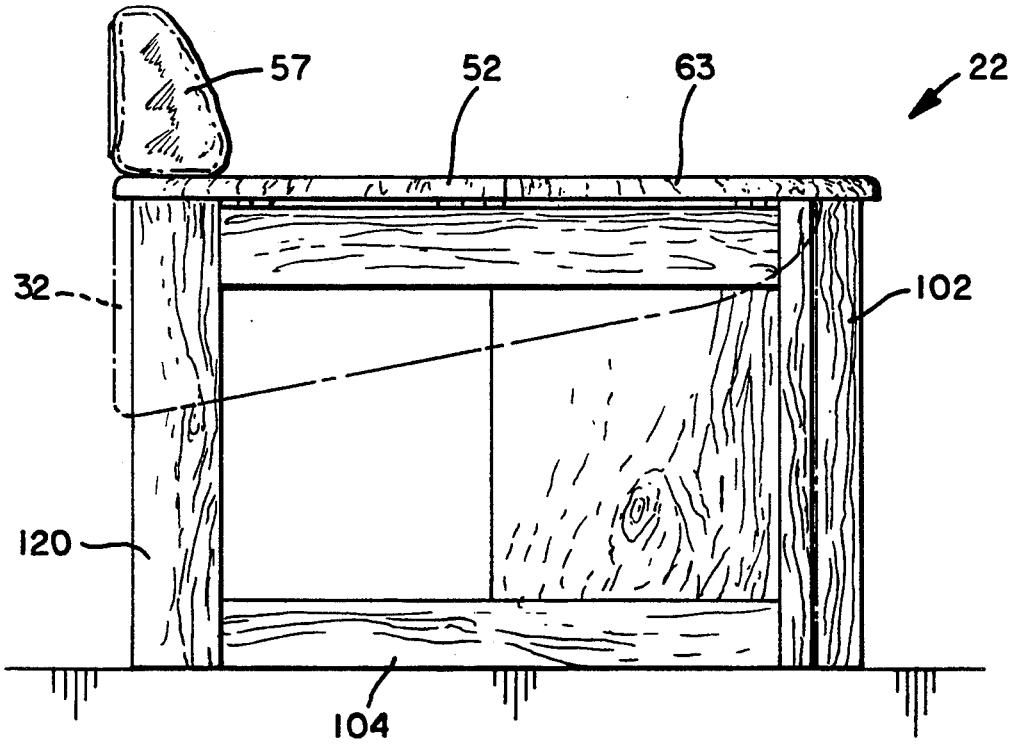
FIG. 8 is a left-side view of the present invention.
Figure 9:
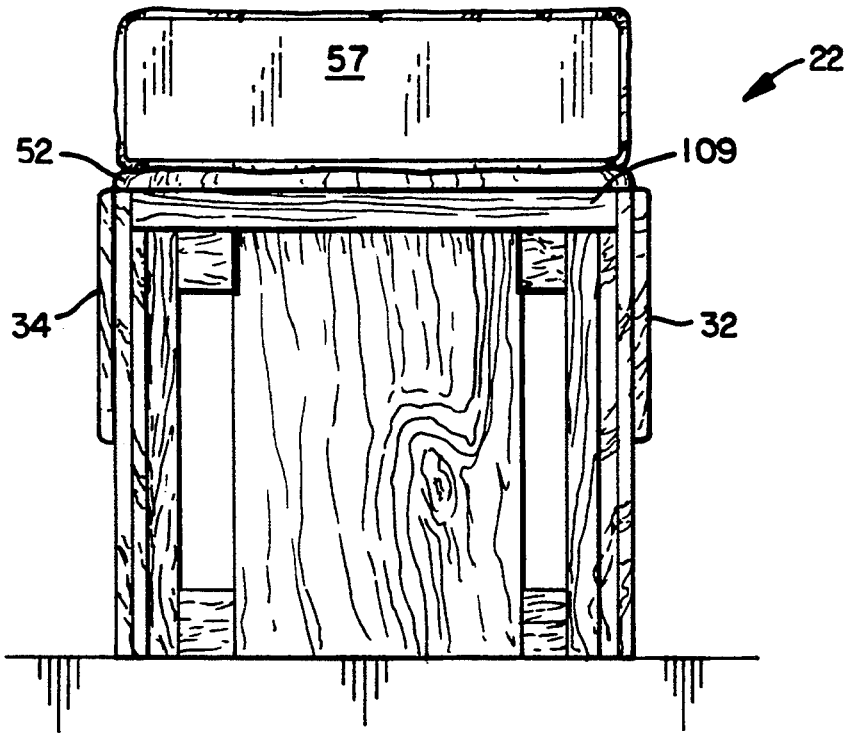
FIG. 9 is a rear view of the present invention.
Figure 10:
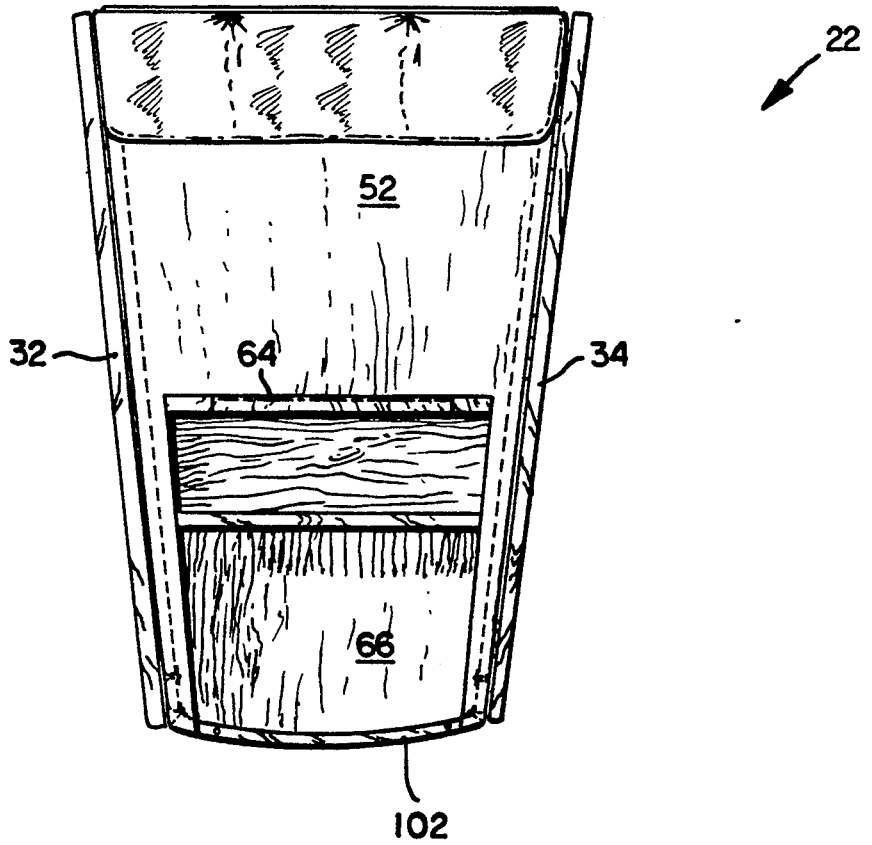
FIG. 10 is a top view of the present invention with both leaves down.
Figure 11:
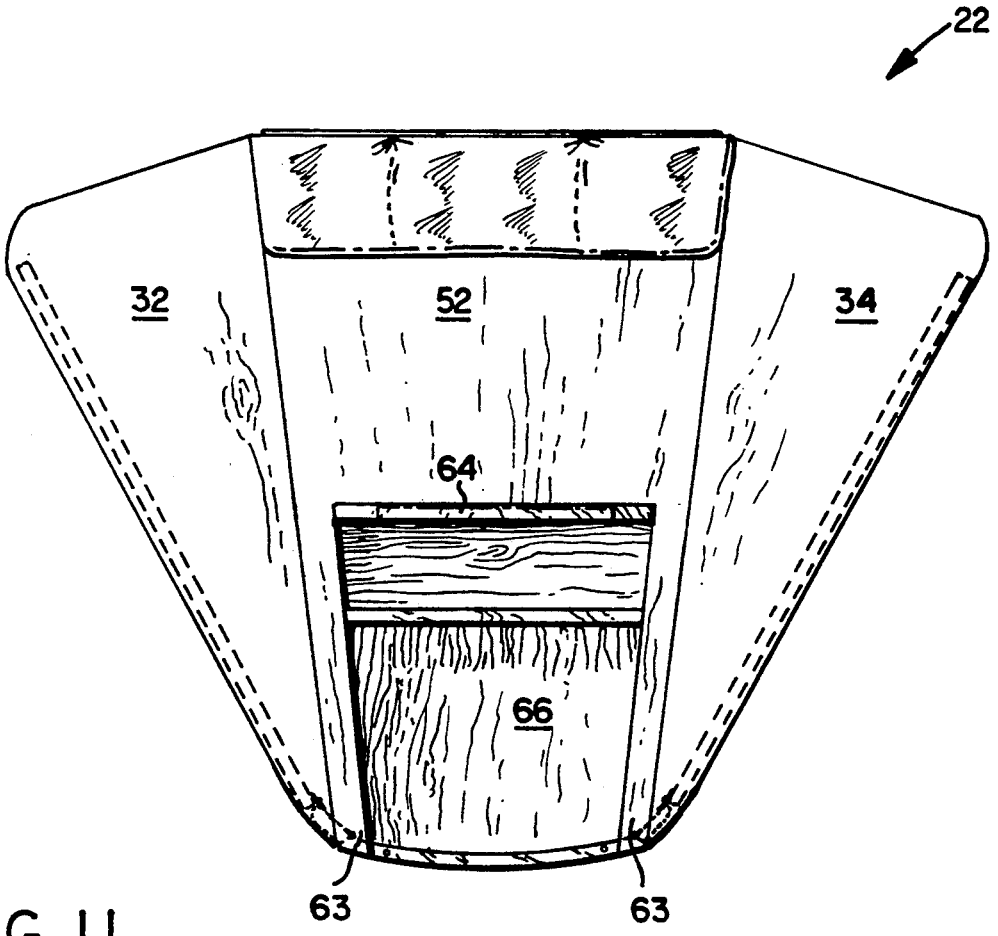
FIG. 11 is a top view of the present invention with right and left side wings extended and the leaf support mechanism shown in dotted outline and upholstered galleries removed.
Figure 12:
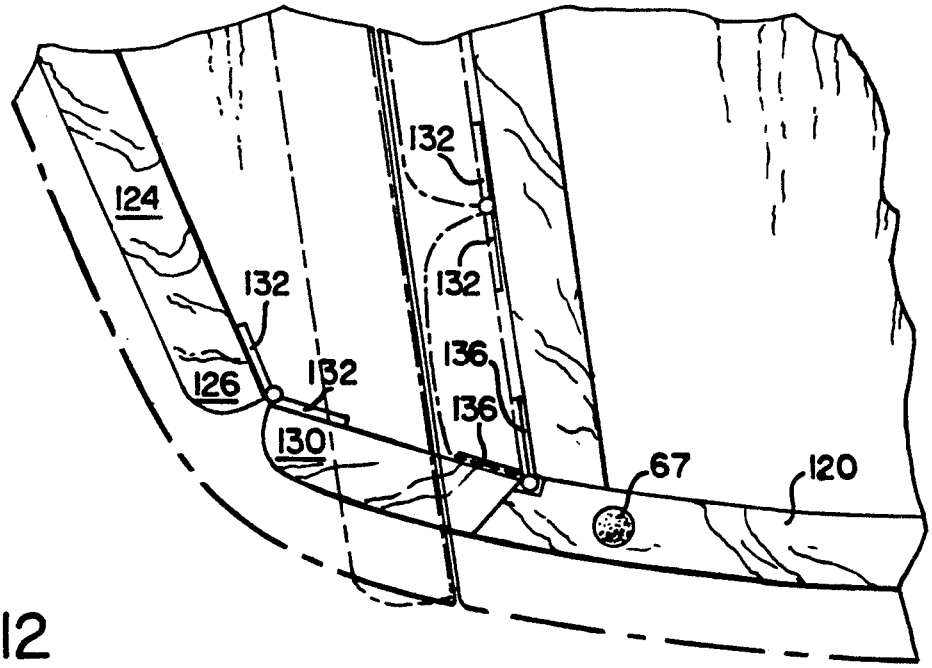
FIG. 12 is a detailed view of a portion of the frame and leaf support mechanism on the base of the present invention with alternative positions of the leaf support and leaf shown in dotted outline.

FIGS. 2 and 3 depict another significant feature of the adjustable storage table 22. The storage table includes an upper facing or top surface 52 having a front edge 54, a back edge 56, a right edge 58, and a left edge 60. Together, the right edge 58 and left edge 60 define an acute angle. Preferably, the angle between the right edge 58 and the left edge 60 is approximately 15 degrees. A forward portion of the top surface 52 is hingedly connected about axis 62 to provide a forward access door 64 into a storage compartment 65 with a bottom surface 66. Preferably, the top surface 52 may extend along side each side of the access door 64 to provide additional stability to the top surface 52 combination with the access door 64. The extension is shown at 63 in FIG. 4. The storage compartment 65 provides convenient storage for items such as magazines or television remote control devices. Most preferably, when closed, the access door 64 comes to rest on felt pads or cushions 67.

Note that the angle between the seating units is particularly useful to orient several seating units towards a central focus point at which might be located, for example, a television set. Because the size of a room may often dictate the distance to the television set or other focal point and additionally, the number of seating units which might be placed in a room, the adjustable angle feature of the adjustable storage table 22 is particularly suited to adapting to a variety of room sizes.

Right leaf 32 has a right edge 70 and a left edge 72. Right and left edges 70 and 72 of right leaf 32 are acutely angled with respect to each other. Preferably right edge 70 and left edge 72 have an angle of approximately 15 degrees between them. Left edge 72 is hingedly connected to the top surface 52 of table 22 adjacent right edge 58 of top surface 52 by three hinges 105 on the underside of the top surface 52 and leaf 32. At least the forward most hinge of the three hinges 105 is located on the extension 63. When right leaf 32 is extended, that is rotated about hinge axis 59 (of hinges 105) to a horizontal position, it forms an extension to top surface 52 and provides a right edge 70 of right leaf 32 with an angle of approximately 30 degrees relative to the left edge 60 of the top surface 52. Extension of the right leaf, therefore, provides a storage table 22 for interposition between seating units located at approximately 30 degrees to each other.

In a similar manner, a left leaf 34 also has a right edge 82 hingedly connected to the top surface 52 of table 22 adjacent left edge 60 of the top surface 52 by three hinges on the underside of both pieces. Left leaf 34 additionally has a left edge 84 which is acutely angled to right edge 82 and most preferably defines an angle of approximately 15 degrees between these two edges 82 and 84. Thus, in a preferred embodiment, when both leaves 32 and 34 are extended, edges 70 and 84 form an angle of approximately 45 degrees with respect to each other.

Figure 13:
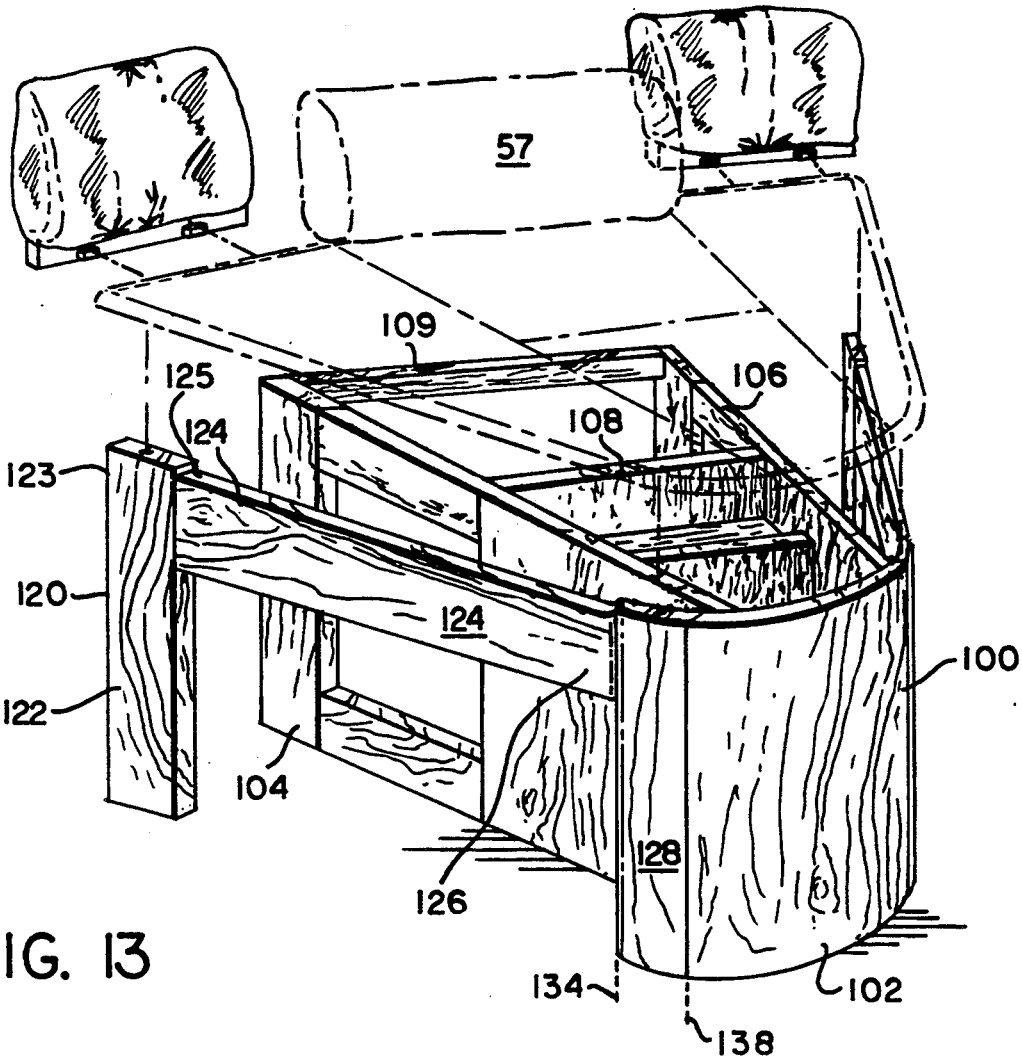
FIG. 13 is an exploded perspective view with the top surface, door and leaves shown in dotted outline.

Top surface 52, including access door 64, and the extendable wings 32 and 34 are all supported by a base 100. The base 100 is a generally wedge-shaped structure which is truncated near the apex of the wedge and thus has a relatively narrow front face 102 (preferably with a slight convex curvature about a vertical axis), attached to a right frame 104 and a left frame 106 (as shown in FIG. 13). Right frame 104 and left frame 106 are also interconnected by an intermediate vertical cross-member 108. The positioning of intermediate cross-member 108 generally corresponds to the axis 62 of the hinge connecting the access door 64 to the top surface 52. Additionally, the portions of the right frame 104 and left frame 106 and intermediate cross section 108 comprising the storage area 65 are preferably formed of plywood or other similar sheet material whereas the portions of the right frame and left frame rearward of the storage area may be unsheeted framing members such as hard or soft wood lumber which allows for a reduction of material costs and weight. A rear rail 109 extends between the rearward upper corners of the right frame 104 and the left frame 106. Those familiar with the art of construction of modern furniture will readily recognized that the table of the present invention is particularly well suited to production and shipment by knock-down ("K-D") construction methods to save shipping expense. If a knock down construction is to be employed, wooden cleats and predrilled holes for receiving screws and other fasteners would be appropriately located to facilitate indexing, alignment, and assembly. The attachment of the top surface 52 to the base 100 would be by means of screws or similar fasteners driven upward through the right and left frames 104 and 106, rear rail 109 and wooden cleats (not shown) on the upper inside edge of the front face 102.

Support for the extended leaves 32 and 34 is perhaps most easily understood in terms of a description of the leaf support structure 120 for the right extension leaf 32. (The support system for the left extension leaf 34 is a mirror image of the right support structure.) The right support structure 120 includes three major pieces: a rear leg 122 rising vertically from the floor to support the rearward end of a horizontal rail 124. These two units are rigidly connected, for example, by a mortise and dowel joint (or alternative well-known furniture construction and joinery methods) at the upper end 123 of vertical member 122 and the rearward end 125 of rail 124. The forward end 126 of rail 124 is hingedly connected to a forward vertical member 128 at its upper end 130. The preferred hinged connecting means is a hinge 132 with a vertical axis 134. Vertical member 128 is also hingedly connected to the right edge of the front face 102 of base 100 by a hinge 136 which has a vertical hinge axis 138 adjacent the right edge of front face 102.

In a preferred embodiment, the right support 120 can occupy two different positions. In the unused position, the rear leg 122, vertical member 128, and horizontal rail 124 are all located adjacent the right frame 104. When so situated, a minor overhang of the top surface 52, including the access door 64, overlaps the support mechanism 120, allowing right leaf 32 to hang vertically from its hinged connection to the table 22. As leaf 32 is lifted and rotated about axis 59 into a horizontal orientation, the support mechanism 120 may be moved away from the right frame 104 such that the front vertical support member 1128 is rotated about hinge axis 138 and moved away from the right frame number 104. Additionally, the horizontal support rail 124 is rotated relative to the front support member 128 such that it is supporting and nearly adjacent to the right edge 70 of right leaf 32. In this manner, the second or supporting position is established. Of course, this process is reversible.

An additional aspect of this support mechanism 120 is that front vertical member 128 appears as an extension to the front surface 102 and additionally provides the added spacing required between motion furniture seating units such that ottomans may be simultaneously extended without interference when the great angle associated with use of the leaf is employed. A mirror image of this mechanism 120 is provided for support of the left leaf 34. In a particularly preferred embodiment, the rear edge 56 of top surface 52 adjoins a removable upholstered cushion 57. Similar cushions can be provided, in removable form, for the backs of leaves 32 and 34, to provide an attractive appearance to the table 22 and the entire grouping of furniture 20.

In summary, the present invention provides an attractive and versatile storage table which can function as an interposed table at several angles between seating units. It can also serve as an arm rest to seating units lacking arm rests. Because it can shift between several difference angles, it can allow reconfiguration of a seating arrangement to adjust to different room dimensions and focal points such as viewing points (television) or listening points (stereo). The double pivot aspect of the leaf support system provides an attractive front face which varies in spacing to accommodate simultaneous extension of ottomans of angled motion seating units adjacent each side of the table.

Although the present invention has been described with reference to the preferred embodiments, workers skilled in the art will recognize that changes may be made in form and detail without departing from the spirit and scope of the invention.

What is claimed is:

1. An adjustable storage table comprising:

a wedged shaped base truncated by a front face having right and left edges;

a top surface having a front edge, a back edge, a right edge and a left edge, the right, and left edge defining about a 15 degree angle there between;

a right leaf having a left edge hingedly connected to the right edge of the top surface and having a right leaf edge defining about a 15 degree angle with respect to the left hingedly connected edge;

a right leaf support including a horizontal rail, and a rearwardly mounted leg on the horizontal rail, the rail being hingedly connected to a front vertical support which in turn is hingedly Connected to the right edge of the front face of the wedge-shaped base about a first and a second pivot axis;

a left leaf having a right edge hingedly connected to the left edge of the top surface and having a left leaf edge defining about a 15 degree angle with respect to the right hingedly connected edge of the left leaf;

a left leaf support including a horizontal rail and a rearwardly mounted leg on the horizontal rail, the horizontal rail being hingedly connected to a vertical support near the front of the rail which vertical support is in turn hingedly connected to the left edge of the front face of the wedge-shaped base; and a storage compartment within the base, accessible through a hinged portion of the top surface, such hinged portion of the top surface defining a storage compartment door.

2. A modular seating system, comprising:

a first motion seating unit having a first extendable ottoman;

a second motion seating unit having a second extendable ottoman;

an adjustable storage table interposed between the first and second motion seating units, such that the edges of the motion seating units adjoin the table edges, the table including:

a top surface having a front edge, a back edge, a right edge and a left edge, the right and left edge defining about a 15 degree angle there between;

a right leaf having a left edge hingedly connected to the right edge of the top surface and having a right leaf edge defining about a 15 degree angle with respect to the left hingedly connected edge;

a right leaf support including a horizontal rail, and a rearwardly mounted leg on the horizontal rail, the rail being hingedly connected to a front vertical support which in turn is hingedly connected to a right edge of a front face truncating a wedge-shaped base and defining a first and a second pivot axis;

a left leaf having a right edge hingedly connected to the left edge of the top surface and having a left leaf edge defining about a 15 degree angle with respect to the right hingedly connected edge of the left leaf; and a left leaf support including a horizontal rail and a rearwardly mounted leg on the horizontal rail, the horizontal rail being hingedly connected to a vertical support near the front of the rail which vertical support is in turn hingedly connected to a left edge of the front face truncating the wedge-shaped base and wherein actuating at least one leaf of the adjustable storage table alters the angle between the first motion seating unit and the second motion seating unit while simultaneously maintaining a compensatory space between the first motion seating unit and the second motion seating unit to allow simultaneous extension of the ottomans.

* * * * *